US007859513B2

(12) United States Patent
Machida et al.

(10) Patent No.: US 7,859,513 B2
(45) Date of Patent: Dec. 28, 2010

(54) IMAGE DISPLAY DEVICE THAT CAN SUPPRESS A REDUCTION IN DISPLAY DENSITY DUE TO CHANGES IN THE CHARGE AMOUNT OF CHARGED PARTICLES

(75) Inventors: Yoshinori Machida, Ashigarakami-gun (JP); Atsushi Hirano, Ashigarakami-gun (JP); Takeshi Matsunaga, Ashigarakami-gun (JP); Yasufumi Suwabe, Ashigarakami-gun (JP); Yoshiro Yamaguchi, Ashigarakami-gun (JP); Motohiko Sakamaki, Ashigarakami-gun (JP); Kiyoshi Shigehiro, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1026 days.

(21) Appl. No.: 11/348,399

(22) Filed: Feb. 7, 2006

(65) Prior Publication Data

US 2007/0018945 A1 Jan. 25, 2007

(30) Foreign Application Priority Data

Jul. 25, 2005 (JP) ..... 2005-215025

(51) Int. Cl.
*G09G 3/34* (2006.01)

(52) U.S. Cl. ..... 345/107

(58) Field of Classification Search ..... 345/107, 345/589, 105; 359/296
See application file for complete search history.

(56) References Cited

U.S. PATENT DOCUMENTS 3,637,291 A * 1/1972 Kessler et al. ..... 349/21
4,251,136 A * 2/1981 Miner et al. ..... 349/50
4,401,983 A * 8/1983 Tabata et al. ..... 345/105
4,464,061 A * 8/1984 Kamiya ..... 368/202
4,806,443 A 2/1989 Yanus et al.
5,892,504 A * 4/1999 Knapp ..... 345/204
6,750,843 B2 * 6/2004 Sakamaki et al. ..... 345/105
2002/0050976 A1 * 5/2002 Yamaguchi et al. ..... 345/105
2002/0175882 A1 * 11/2002 Edwards et al. ..... 345/55
2002/0196390 A1 * 12/2002 Penterman et al. ..... 349/73
2003/0132908 A1 * 7/2003 Herb et al. ..... 345/107

(Continued)

FOREIGN PATENT DOCUMENTS

JP A 10-3177 1/1998

(Continued)

*Primary Examiner*—Chanh Nguyen
*Assistant Examiner*—Robert M Stone
(74) *Attorney, Agent, or Firm*—Oliff & Berridge, PLC

(57) ABSTRACT

An image display device is provided. The image display device has: an image display medium where charged particle groups are sealed between a pair of substrates at least one of which has translucency and which are opposed to each other with a space therebetween, and display density is changed by transfer of the charged particle groups between the pair of substrates according to an electric field formed by a voltage applied between the substrates; a temperature measuring unit that measures a temperature of the image display medium; a voltage applying unit that applies, between the substrates, a driving voltage according to the temperature of the image display medium measured by the temperature measuring unit, based on a predetermined voltage applying condition corresponding to the temperature of the image display medium, in order to display an image with predetermined display density on the image display medium.

13 Claims, 5 Drawing Sheets

U.S. PATENT DOCUMENTS

| | | | | |
|---|---|---|---|---|
| 2003/0137521 | A1* | 7/2003 | Zehner et al. | 345/589 |
| 2005/0001810 | A1* | 1/2005 | Yakushiji et al. | 345/107 |
| 2005/0162378 | A1* | 7/2005 | Zhou et al. | 345/107 |
| 2005/0231460 | A1* | 10/2005 | Zhou et al. | 345/107 |
| 2006/0050033 | A1* | 3/2006 | Asao et al. | 345/88 |
| 2006/0209007 | A1* | 9/2006 | Pyo et al. | 345/105 |
| 2007/0052665 | A1* | 3/2007 | Zhou et al. | 345/107 |
| 2007/0075962 | A1* | 4/2007 | Zhou et al. | 345/107 |

FOREIGN PATENT DOCUMENTS

| | | | | |
|---|---|---|---|---|
| JP | A 2000-3383 | | 1/2000 | |
| JP | A 2000-347483 | | 12/2000 | |
| JP | A 2001-312225 | | 11/2001 | |
| WO | WO2005027087 | * | 3/2005 | 345/107 |

* cited by examiner

EXAMPLE OF RELATIONSHIP BETWEEN TEMPERATURE OF DISPLAY MEDIUM AND DISPLAY DENSITY CHARACTERISTICS

FIG.4

| | TEMPERATURE OF DISPLAY MEDIUM (°C) | -20 | 0 | 20 | 40 | 60 | 70 | 80 | 100 | 120 | 150 |
|---|---|---|---|---|---|---|---|---|---|---|---|
| IMAGE DISPLAY MEDIUM A | CHARGED PARTICLES A WITH EXTERNAL ADDITIVE OF CHARGE CONTROL AGENT | ◎ | ◎ | ◎ | ◎ | ◎ | ○ (T1) | ○ | △ (T2) | △ | × |
| IMAGE DISPLAY MEDIUM B | CHARGED PARTICLES B CONTAINING CHARGE CONTROL AGENT | ◎ | ◎ | ◎ | ◎ | ○ (T1) | ○ | △ (T2) | △ | × | × |

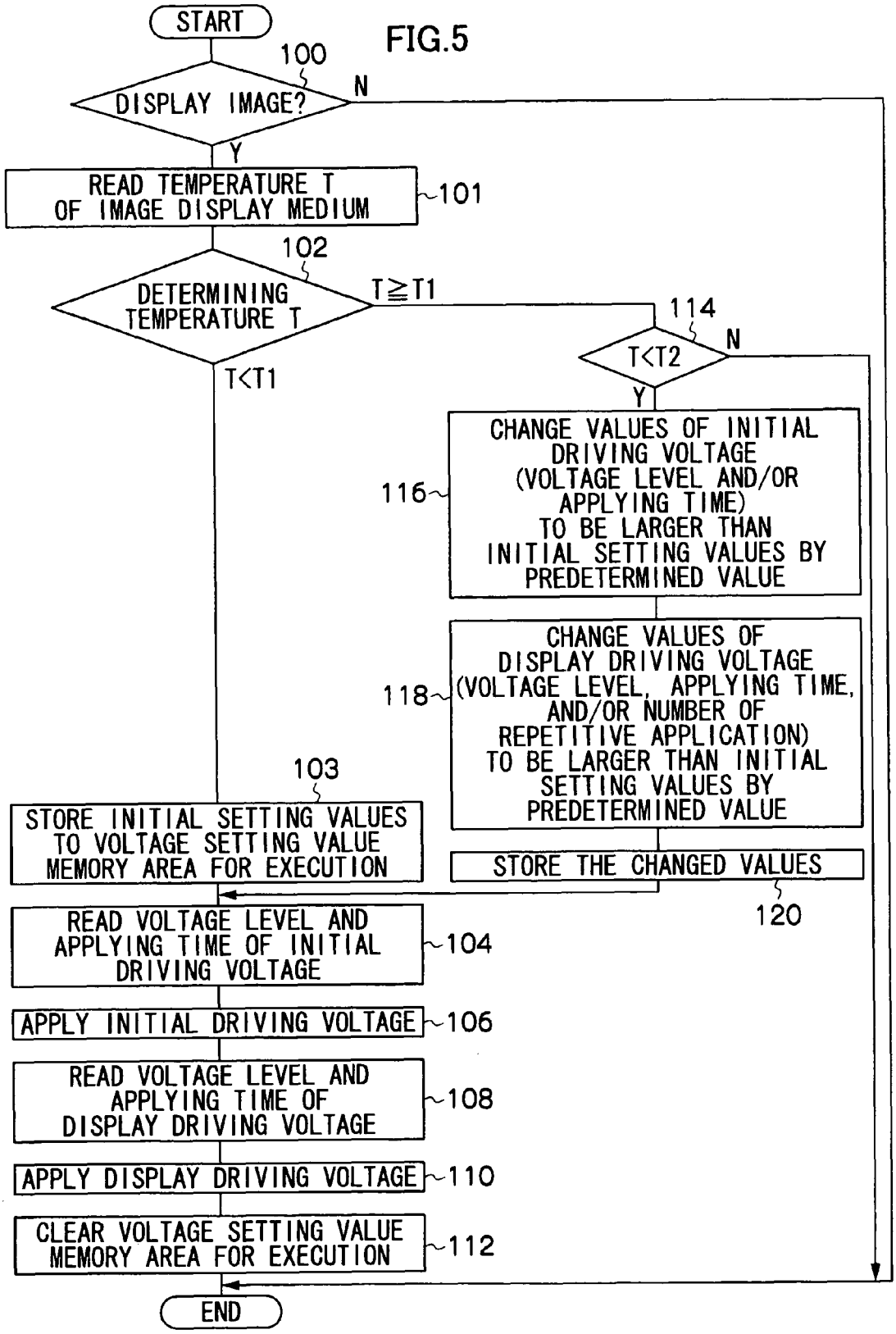
FIG.5
START
100
DISPLAY IMAGE?
N
Y
READ TEMPERATURE T OF IMAGE DISPLAY MEDIUM
101
102
DETERMINING TEMPERATURE T
T≧T1
T<T1
114
T<T2
N
Y
CHANGE VALUES OF INITIAL DRIVING VOLTAGE (VOLTAGE LEVEL AND/OR APPLYING TIME) TO BE LARGER THAN INITIAL SETTING VALUES BY PREDETERMINED VALUE
116
CHANGE VALUES OF DISPLAY DRIVING VOLTAGE (VOLTAGE LEVEL, APPLYING TIME, AND/OR NUMBER OF REPETITIVE APPLICATION) TO BE LARGER THAN INITIAL SETTING VALUES BY PREDETERMINED VALUE
118
STORE THE CHANGED VALUES
120
103
STORE INITIAL SETTING VALUES TO VOLTAGE SETTING VALUE MEMORY AREA FOR EXECUTION
READ VOLTAGE LEVEL AND APPLYING TIME OF INITIAL DRIVING VOLTAGE
104
APPLY INITIAL DRIVING VOLTAGE
106
READ VOLTAGE LEVEL AND APPLYING TIME OF DISPLAY DRIVING VOLTAGE
108
APPLY DISPLAY DRIVING VOLTAGE
110
CLEAR VOLTAGE SETTING VALUE MEMORY AREA FOR EXECUTION
112
END

IMAGE DISPLAY DEVICE THAT CAN SUPPRESS A REDUCTION IN DISPLAY DENSITY DUE TO CHANGES IN THE CHARGE AMOUNT OF CHARGED PARTICLES

CROSS-REFERENCE TO RELATED APPLICATION

This application claims priority under 35 USC 119 from Japanese Patent Application No. 2005-215025, the disclosure of which is incorporated by reference herein.

BACKGROUND OF THE INVENTION

1. Field of the Invention

The present invention relates to an image display device and an image display method. In particular, the invention relates to an image display device having an image display medium whose display density is changed by transfer of charged particle groups according to an electric field formed by a voltage applied between a pair of substrates of the image display medium, and an image display method in such an image display device.

2. Description of the Related Art

Conventionally, as an image display medium (display device) where repetitive rewriting is enabled, image display media which are configured such that colored particles such as fine particle toner are sealed between a pair of substrates have been proposed (see, for example, Japanese Patent Application Laid-Open (JP-A) Nos. 2000-347483, 2001-3383 and 2001-312225).

These media are configured such that two types of charged particle groups whose colors and charging characteristics are different are sealed between a transparent display substrate and a rear substrate which are opposed to each other with a space therebetween. The two types of charged particle groups are respectively charged with opposite polarities. By applying electric field between the display substrate and the rear substrate, the two kinds of charged particle groups transfer (move) between the substrates, and display density is thereby changed and displaying is performed. In this image display medium, by applying a voltage between the substrates according to image information, a clear image can be displayed with high contrast.

In the above conventional technique, however, when the temperature of the image display medium rises due to a rise in environmental temperature, the charge amount of the charged particles changes due to changes in characteristics of the charged particles, outgas generated from various members structuring the image display medium, changes in surface shape and surface state of the charged particles caused by bumping of the charged particles due to repetitive rewriting, and the like. Particularly, when the temperature of the charged particles rises to a predetermined temperature or more, it is known that the charge amount is extremely reduced.

When the charge amount of the charged particles is reduced, it becomes difficult for the charged particle groups to transfer between the substrates when a display driving voltage for displaying an image on the image display medium is applied between the substrates. Such reduction in response to the voltage applied to the charged particle groups gives rise to the problem of reduction in display density.

SUMMARY OF THE INVENTION

The present invention is devised in view of the above circumstances, and provides an image display device and an image display method that can suppress a reduction in display density due to changes in the charge amount of charged particles.

A first aspect of the invention provides an image display device, including: an image display medium wherein charged particle groups are sealed between a pair of substrates at least one of which has translucency and which are opposed to each other with a space therebetween, and display density is changed by transfer of the charged particle groups between the pair of substrates according to an electric field formed by a voltage applied between the substrates; a temperature measuring unit that measures a temperature of the image display medium; and a voltage applying unit that applies, between the substrates, a driving voltage according to the temperature of the image display medium that is measured by the temperature measuring unit, based on a predetermined voltage applying condition corresponding to the temperature of the image display medium in order to display an image in predetermined display density on the image display medium.

In the image display medium of the image display device according to this aspect, the charged particle groups transfer between the pair of substrates according to the electric field formed by the voltage applied between the substrates, and thereby the display density changes. The voltage applying unit predetermines a voltage applying condition with respect to the temperature of the image display medium in order to display an image in predetermined display density on the image display medium. That is, the voltage applying unit predetermines the voltage applying condition with respect to the temperature of the image display medium so that the charged particle groups transfer between the substrates in order to display the image on the image display medium with predetermined display density. The voltage applying unit applies, between the substrates, the driving voltage based on the voltage applying condition according to the temperature of the image display medium measured by the temperature measuring unit.

Thus, driving voltage based on the voltage applying condition for displaying an image on the image display medium with predetermined display density is applied between the substrates according to the temperature of the image display medium. Therefore, even when the charged particle groups are in an environmental temperature under which the charge amount cannot attain the predetermined display density due to a change in the temperature, the driving voltage based on the voltage applying condition corresponding to the temperature of the image display medium into which the charged particle groups are sealed can be applied between the substrates. Thus, even when the charge amount of the charged particle groups is reduced due to the change in environmental temperature, reduction of the display density can be suppressed.

The present invention can be realized as a method according to the above image display device. That is, a second aspect of the invention provides an image display method of displaying an image on an image display device having an image display medium, the image display medium being configured such that charged particle groups are sealed between a pair of substrates at least one of which has translucency and which are opposed to each other with a space therebetween, and display density is changed by transfer of the charged particle groups between the pair of substrates according to an electric field formed by a voltage applied between the substrates, the method including: measuring the temperature of the image display medium with a temperature measuring unit; and applying, between the substrates, a driving voltage according to the temperature of the image display medium which is measured by the temperature measuring unit, based on a predetermined voltage applying condition corresponding to the temperature of the image display medium, in order to display an image in predetermined display density on the image display medium.

BRIEF DESCRIPTION OF THE DRAWINGS

An embodiment of the present invention will be described in detail based on the following figures, wherein:

FIG. 4 is a table showing a relationship between the temperature and display characteristics of the image display medium with respect to two types of charged particles with different compositions; and FIG. 5 is a flowchart illustrating a process which is executed by a voltage applying unit of the image display device.

DETAILED DESCRIPTION OF THE INVENTION

An embodiment of the present invention is explained in detail below based on the drawings.

Figure 1:
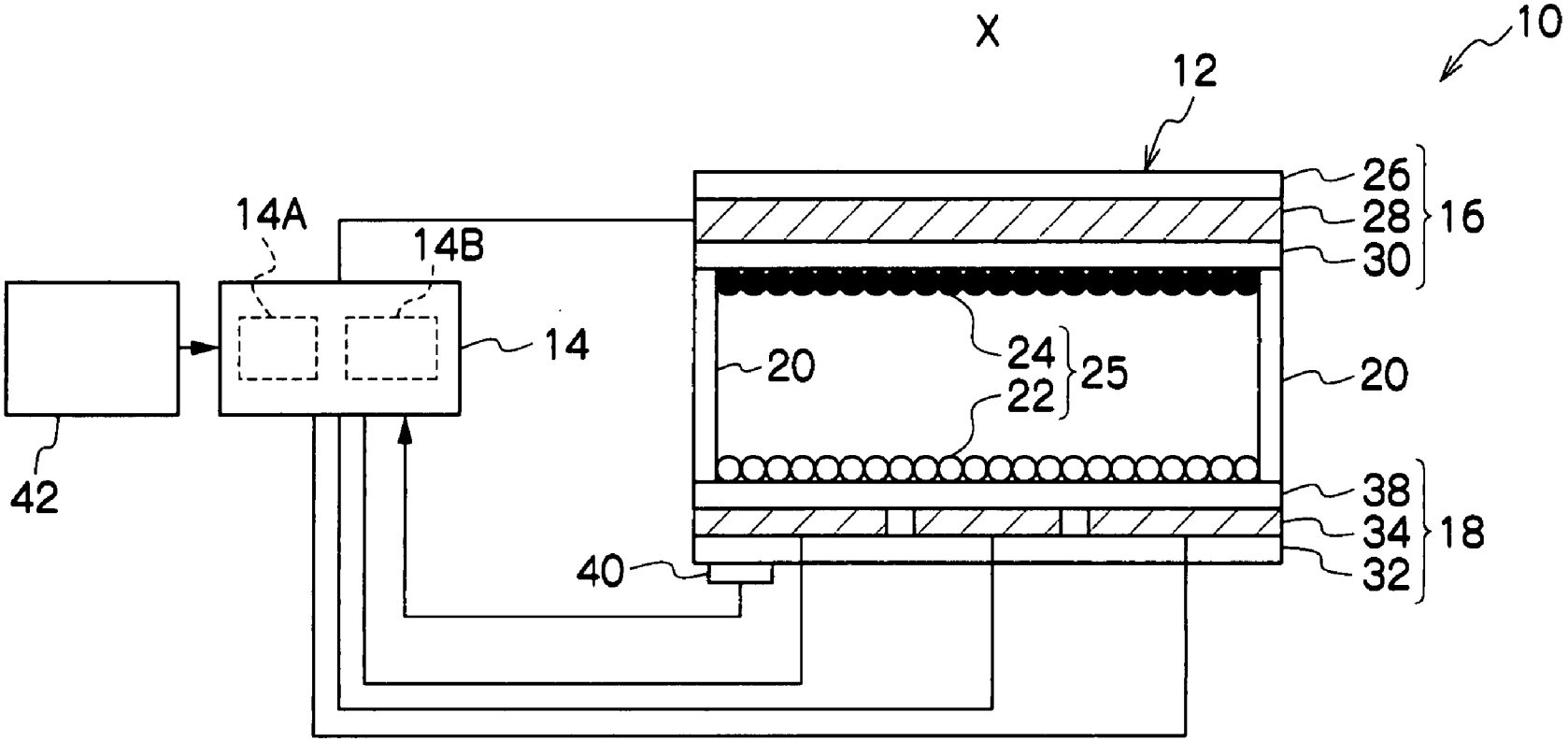
FIG. 1 is a schematic diagram illustrating an image display device according to the present invention.

As shown in FIG. 1, an image display device 10 has an image display medium 12 for displaying images, a voltage applying unit 14 for applying driving voltage to the image display medium 12, and a temperature measuring unit 40 for measuring a temperature of the image display medium 12.

The image display medium 12 includes a transparent display substrate 16 provided at a visual recognition side X, a transparent rear substrate 18 opposed to the display substrate 16 with a space therebetween, a spacing member 20 that maintains a predetermined space between the substrates, white charged particles 22 and black charged particles 24 sealed between the substrates (hereinafter, generally referred to as charged particle groups 25).

The display substrate 16 is configured such that a linear electrode 28 and an insulating layer 30 are laminated on a transparent supporting substrate (or glass substrate) 26. The linear electrode 28 is formed into plural lines on the supporting substrate 26 by an ITO (indium tin oxide) electrode film.

The linear electrode 28 is provided for each pixel line in a predetermined direction of a display image to be displayed on the image display medium 12. Plural linear electrodes 28 may also be provided for each pixel line of the display image.

The rear substrate 18 is configured such that a linear electrode 34 and an insulating layer 38 are laminated on a supporting substrate 32. The linear electrode 34 is formed into plural lines on the supporting substrate 32 by a copper electrode or the like.

The linear electrode 34 is provided for each pixel line in a direction orthogonal to the linear electrode 28 formed on the display substrate 16. Plural linear electrodes 34 may also be provided for each pixel line of the display image.

The white charged particles 22 and the black charged particles 24 compose particle groups whose charging characteristics are different, and in this embodiment, their polarities are configured to be opposite (e.g., one group is charged positively and the other group is charged negatively). In this embodiment, in order to simplify the explanation, the case where the black charged particles 24 are charged positively and the white charged particles 22 are charged negatively is explained. However, the polarities may be switched (i.e., the black charged particles 24 may be charged negatively and the white charged particles 22 may be charged positively).

The temperature measuring unit 40 is provided so as to contact with an outer surface of the rear substrate 18 and is capable of measuring the temperature of the rear substrate 18. The temperature measuring unit 40 may be provided at a position where the temperature of the image display medium 12 can be measured. Namely, the temperature measuring unit 40 may be provided at an outer surface of the display substrate 16, inside of the display substrate 16, at a surface of the display substrate 16 facing the rear substrate 18, a surface of the rear substrate 18 facing the display substrate 16, or inside of the rear substrate 18. Moreover, the temperature measuring unit 40 may be provided on the spacing member 20, or may be provided integrally with the spacing member 20. It is most preferable that the temperature measuring unit 40 is provided at a position where the temperature of the charged particle groups 25 can be measured accurately, and it may be provided at a position between the display substrate 16 and the rear substrate 18 where the transfer of the charged particle groups 25 is not interrupted.

When the temperature measuring unit 40 cannot be mounted directly to the image display medium 12, the temperature measuring unit 40 may be arranged in a position as close to the image display medium 12 as possible. Alternately, a temperature relationship between the environmental temperature and the image display medium 12 can be measured in advance, and the temperature of the image display medium 12 may be calculated from the environment temperature measured by the temperature measuring unit 40.

The voltage applying unit 14 is connected to the temperature measuring unit 40, the linear electrodes 28 and the linear electrodes 34 so that data and signals can be transmitted and received therebetween. The voltage applying unit 14 selectively applies a driving voltage to the image display medium 12 according to image information input from an image information input unit 42 that is for outputting, to the voltage applying unit 14, image information of an image to be displayed on the image display medium 12. In this embodiment, the driving voltage, which is applied to the image display medium 12 when the image according to the image information is displayed on the image display medium 12, is referred to as a display driving voltage.

The voltage applying unit 14 applies the driving voltage to each of the linear electrode 28 and the linear electrode 34 of the image display medium 12 according to image information input from the image information input unit 42. The voltage applying unit 14 includes a storage unit 14B and a control unit 14A. The storage unit 14B stores in advance a voltage applying condition, which is predetermined according to the temperature of the image display medium 12 in order to display an image in predetermined display density on the image display medium 12, and a processing routine whose details are described below (see FIG. 5), and also stores various data. The control unit 14A executes the processing routine, described below, for applying, to the image display medium 12, a driving voltage based on the voltage applying condition corresponding to the temperature measured by the temperature measuring unit 40, and controls respective units of the image display device 10.

The display substrate 16 and the rear substrate 18 correspond to the substrate of the invention, and the white charged particles 22 and the black charged particles 24 (charged particle groups 25) correspond to the charged particle groups of the invention. The image display medium 12 corresponds to the image display medium of the invention, and the voltage applying unit 14 corresponds to the voltage applying unit of the invention.

Method of Manufacturing the Image Display Medium

As the display substrate 16 of the image display medium 12, a transparent and conductive ITO supporting substrate of 70 mm×50 mm×1.1 mm is used in this embodiment. Plural linear electrodes 28 having a width of 0.234 mm and a space of 0.02 mm between each other are formed on the supporting substrate 26 by etching. An ITO supporting substrate of 70 mm×50 mm×1.1 mm is used as the rear substrate 18 as well. Plural linear electrodes 34 having a width of 0.234 mm and a space of 0.02 mm between each other are formed on the supporting substrate 32 by etching. Transparent polycarbonate resin is applied to the opposed surfaces of the display substrate 16 and the rear substrate 18 to a thickness of about 5 μm, so that the insulating layers 30 and 38 are formed.

The space between the display substrate 16 and the rear substrate 18 is formed by applying thermosetting epoxy resin to the rear substrate 18 in a desired pattern by means of screen printing and thermally hardening it, and this step is repeated until a necessary height is obtained. A display area of the image display medium 12 is 20 mm×20 mm, and its height is 100 μm. The spacing member 20 can be formed by adhering, to the rear substrate 18, a thermoplastic film formed into a desired surface shape by injection compression molding, embossing, thermal pressing or the like. By the embossing or the thermal pressing, the spacing member 20 can be formed integrally with the rear substrate 18. Needless to say, the spacing member 20 may be formed on the side of the display substrate 16 or formed integrally with the display substrate 16 unless the translucency of the display substrate 16 is deteriorated thereby.

As the charged particle groups 25, spherical black charged particles 24 (Techpolymer MBX-Black manufactured by SEKISUI PLASTICS CO., LTD.) and spherical white charged particles 22 (Techpolymer MBX-White manufactured by SEKISUI PLASTICS CO., LTD.) are used, and they are mixed at a weight ratio of 3 to 5. The black charged particles 24 are made of carbon-containing crosslinking polymethyl methacrylate having a primary volume average grain size of 10 μm, mixed with Aerosil A130 impalpable (fine) powder which is subject to aminopropyltrimethoxysilane treatment, at a weight ratio 100 to 0.2. The spherical white charged particles 22 are made of titanium oxide-containing crosslinking polymethyl methacrylate having a primary volume average grain size of 10 μm, mixed with a Titania impalpable powder which is subject to isopropyltrimethoxysilane treatment, at a weight ratio of 100 to 0.1. At this time, the black charged particles 24 are charged positively, and the white charged particles 22 are charged negatively due to mutual friction.

About 12 mg of the mixed particles of the black charged particles 24 and the white charged particles 22 are dispersed (shaken off) uniformly into a space between the spacing members 20 on the rear substrate 18 through a screen. The display substrate 16 is overlapped with the rear substrate 18 via the spacing member 20 so that the linear electrode 34 of the rear substrate 18 is laid orthogonal to the linear electrode 28 of the display substrate 16. Both of the substrates are press-held by a double clip so that the spacing member 20 is brought into close contact with both of the substrates, and thereby the image display medium 12 is formed. The total volume ratio of the white charged particles 22 and the black charged particles 24 to the volume of the space between the substrates is made to be about 20%.

On the image display medium 12 created in such a manner, as shown in FIG. 1, the linear electrode 28 of the display substrate 16 is connected to the voltage applying unit 14, and the linear electrode 34 of the rear substrate 18 is connected to the voltage applying unit 14 so that data and signals can be transmitted or received. As a result, the image display device 10 is manufactured.

The mixing ratio of the white charged particles 22 and the black charged particles 24, the total volume ratio of the white charged particles 22 and the black charged particles 24 to the volume of the space between the substrates, and the volume average grain size of the particles are not limited to the above values.

The following particles, the following substrates and the like can be used as the charged particle group 25, the display substrate 16 and the rear substrate 18 which may be used in the image display device 10 of the present invention.

Charged Particles

Examples of the charged particle group 25 which may used in this embodiment include: insulating metal oxide particles such as glass beads, alumina and titanium oxide; thermoplastic resin or thermosetting resin particles; particles where a coloring agent is fixed to the surfaces of the resin particles; particles where thermoplastic or thermosetting resin contains insulating coloring agent; and the like, as well as the above-described charged particle group 25.

Examples of the thermoplastic resin which may be used for manufacturing the charged particle group 25 include: homopolymers or copolymers of: styrenes such as styrene and chlorostyrene; monoolefins such as ethylene, propylene, butylene and isoprene; vinyl ester such as vinyl acetate, vinyl propionate, vinyl benzoate and vinyl butyrate; α-methylene alphatic monocarboxylate such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone, vinyl isopropenyl ketone, and the like.

Examples of the thermosetting resin which may used for manufacturing the charged particle group 25 include: crosslinking copolymers mainly containing divinylbenzene; crosslinking resins such as crosslinking polymethyl methacrylate; phenolic resin; urea resin; melamine resin; polyester resin; silicone resin; and the like. Particularly typical examples of binder resin are polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene, polyester, polyurethane, epoxy resin, silicone resin, polyamid, modified rosin and paraffin wax.

As the coloring agent, organic or inorganic pigments, oil-soluble dyes and the like can be used. Known examples of these coloring agents are magnetic powder such as magnetite and ferrite, carbon black, titanium oxide, magnesium oxide, zinc oxide, copper phthalocyanine cyan coloring material, azo yellow coloring material, azo magenta coloring material, quinacridone magenta coloring material, red coloring material, green coloring material, blue coloring material, and the like. Specifically, typical examples are aniline blue, calco oil blue, chrome yellow, ultramarine blue, Dupont oil red, quinoline yellow, methylene blue chloride, phthalocyanine blue, malachite green oxalate, lamp black, rose bengal, CI Pigment Red 48:1, CI Pigment Red 122, CI Pigment Red 57:1, CI pigment yellow 97, CI pigment blue 15:1, CI Pigment Blue 15:3, and the like. Further, porous sponge-type particles and hollow particles containing air can be used as the white charged particles 22. These are selected such that the two types of particles have a different color tone.

The aforementioned thermoplastic resin or the thermosetting resin may contain a charging control agent which controls the charging of the particles. Examples of such a charging control agent are cetylpyridinyl chloride, quaternary ammonium salt such as BONTRON P-51, BONTRON P-53, BONTRON E-84, BONTRON E-81 (all manufactured by Orient Chemical Industries, Ltd.), salicylic metal complex, phenolic condensate, tetraphenylic compound, metal oxide fine particles, metal oxide fine particles which are subject to surface treatment by various coupling agents, diethylaminoethyl methacrylate, and the like.

The shape of the charged particle group 25 is not particularly limited, but spherical particles whose physical adhesion to the display substrate 16 and the rear substrate 18 is small and have satisfactory flowability are preferable. Suspension polymerization, emulsion polymerization, dispersion polymerization or the like can be used for forming the spherical particles.

The primary volume average grain size of the charged particle group 25 is generally 1 to 1000 μm, and preferably 5 to 50 μm, but the size is not limited thereto. In order to obtain high contrast, it is preferable to set the particle diameters of the two types of charged particle groups 25 to approximately the same value. Thus, a problem of reduction of the original color density of the large particles due to the large particles being surrounded by small particles can be avoided.

External additives may be allowed to adhere to the surface of the charged particle group 25 if needed. By adhering the external additive, the charging characteristics of the charged particle group 25 can be controlled, and flowability can be improved. White or transparent colors for the external additive are preferable so that the color of the charged particle group 25 is not influenced.

As the external additive, inorganic fine particles of metal oxide such as silicon oxide (silica), titanium oxide, alumina, and the like can be used. In order to adjust the charging characteristics, the flowability and environmental dependence of the fine particles, the fine particles can be subject to surface treatment using a coupling agent and silicone oil.

Examples of the coupling agent include positive charge (electrification) coupling agents such as an aminosilane coupling agent, aminotitanium coupling agent, nitrile coupling agent, and the like, and negative charge coupling agents such as a silane coupling agent which does not contain nitrogen atoms (composed of atoms other than nitrogen), titanium coupling agent, epoxy silane coupling agent, acrylic silane coupling agent, and the like. Examples of the silicone oil include positive charging (electrification) silicone oils such as amino modified (denatured) silicone oil and the like, and negative charging silicone oils such as dimethyl silicone oil, alkyl modified silicone oil, α-methysulfone modified silicone oil, methylphenyl silicone oil, chrolophenyl silicone oil, fluorine modified silicone oil, and the like. These are selected according to the desired resistance of the external additive.

Among such external additives, well-known hydrophobic silica and hydrophobic titanium oxide are preferably used. Particularly, a titanium compound described in JP-A No. 10-3177 which is obtained by a reaction between $TiO(OH)_2$ and a silane compound such as a silane coupling agent is suitable. As the silane compound, any one of chrolosilane, alkoxysilane, silazane and special silyl agent can be used. The titanium compound is prepared by reacting a silane compound or silicone oil with $TiO(OH)_2$ prepared by a wet process and then drying it. Since the titanium compound is not subject to a baking process at several hundred degrees, Ti and Ti will not strongly couple, coagulation will not occur at all, and the particles are approximately in a primary particle state. Since the silane compound or silicone oil is directly reacted with $TiO(OH)_2$, the processed amount of the silane compound or the silicone oil can be increased. By adjusting the processed amount of the silane compound and the like, the charging characteristics can be controlled, and the resulting charging ability can be improved more greatly than that of conventional titanium oxide.

The primary volume average grain size of the external additive is generally 5 to 100 nm, and preferably 10 to 50 nm, but the size is not limited thereto.

A compounding ratio of the external additive to the charged particle group 25 is adjusted appropriately according to the particle diameter of the particles and the particle diameter of the external additive. When the added amount of the external additive is too large, a part of the external additive is separated from the surface of the charged particle group 25 and adheres to the surface of the other particles, and thus desired charging characteristics occasionally cannot be obtained. In general, the amount of the external additive is 0.01 to 3 parts by mass, and more preferably 0.05 to 1 part by mass with respect to 100 parts by mass of the charged particles.

The composition of the charged particle groups 25 to be combined, the mixing ratio of the particles, presence or nonpresence of the external additive, the composition of the external additive, and the like are selected in order to obtain desired charging characteristics.

The external additive may be added to one type of the particles, or may be added to both of the charged particle groups 25. When the external additive is added to both types of the particles, it is preferable that external additives with different polarities are used. Further, when the external additive is added to the surfaces of both types of the particles, it is desirable that the external additive is driven into the surfaces of the charged particle groups 25 by applying impact force, or the surfaces of the charged particle groups 25 are heated so that the external additive can be strongly fixed to the surfaces. As a result, the external additive will not separate from the charged particle groups 25, and the external additives with different polarities will not strongly agglutinate. Therefore, aggregate of the external additives which is difficult to dissociate by an electric field is prevented from being formed, and deterioration of an image is prevented.

The contrast depends on the primary volume average grain size of the two types of the charged particle groups 25 and also the mixing ratio of the charged particle groups 25. In order to obtain high contrast, it is desirable that the mixing ratio is determined so that surface areas of the two types of the charged particle groups 25 become substantially the same. When the mixing ratio greatly deviates from such a value, a color of the particles whose mixing ratio is larger is enhanced. However, this is not applied to a case where the two types of the charged particle groups 25 are made to have similar colors with deep tone and pale tone, or a case where a color obtained by mixing the two types of the charged particle groups 25 is used for an image.

Display Substrate and Rear Substrate

Substrates which can be used as the display substrate 16 and the rear substrate 18 in the present embodiment can be structured by general supporting substrates and electrodes. Examples of the supporting substrates 26 and 32 include glass and plastic made of, for example, polycarbonate resin, acrylic resin, polyimide resin, polyester resin, epoxy resin or the like. Oxides such as indium, tin, cadmium and antimony, compound oxides such as ITO, metals such as gold, silver, copper and nickel, organic conducting materials such as polypyrrole and polythiophene, and the like can be used for the electrodes. These materials can be used as a single layer film, a mixed film or a composite membrane. The films can be formed by a vacuum evaporation method, a sputtering method, a coating method and the like. Their thickness is normally 100 to 2000 angstrom when the vacuum evaporation and the sputtering method are used. The linear electrode 34 and the linear electrode 28 can be formed into a desired pattern such as a matrix pattern by known methods such as etching of conventional liquid crystal display elements or printed wiring boards.

The linear electrodes 28 and 34 may be embedded in the display substrate 16 and the rear substrate 18, respectively. In this case, the materials of the display substrate 16 and the rear substrate 18 serve also as a dielectric layer, and this occasionally influences the charging characteristics and the flowability of the charged particle groups 25. For this reason, it is necessary to appropriately select the arrangement according to composites and the like of the charged particle groups 25.

Further, the linear electrodes 28 and 34 may be arranged on the outside of the image display medium 12 so as to be separated from the display substrate 16 and the rear substrate 18.

When the linear electrodes 28 and 34 are respectively formed on the display substrate 16 and the rear substrate 18, dielectric films may be formed as the insulating layers 30 and 38 on the electrodes (linear electrodes 28 and 34) if needed in order to prevent occurrence of a leak between the electrodes which causes a damage to the electrodes and adhesion of the charged particle groups 25. Examples of the dielectric films include polycarbonate, polyester, polystyrene, polyimide, epoxy, polyisocyanate, polyamide, polyvinyl alcohol, polybutadiene, polymethylmethacrylate, copolymer nylon, ultraviolet curing acrylic resin, fluorine resin, and the like.

Besides the above-described insulating materials, an insulating material which contains a charge transport substance can be used. When the material contains the charge transport substance, particle charging characteristics can be improved by charge injection into the charged particle groups 25, and when the charge amount of the charged particle groups 25 becomes extremely large, the electric charges of the charged particle groups 25 are allowed to leak, so that the charge amount of the charged particle groups 25 can be stabilized. Examples of the charge transport substance include the hole transporting substances hydrazone compound, stilbene compound, pyrazoline compound, arylamine compound and the like. Further, fluorenone compound, diphenoquinone derivative, pyrane compound, zinc oxide and the like can be used. Self-supporting resins having a charge transport property can be also used. In particular, examples include polyvinyl carbazole, polycarbonate as disclosed in U.S. Pat. No. 4,806,443 in which specified dihydroxyarylamine and bischloroformate are polymerized, and the like.

Since the dielectric film influences the charging characteristics and the flowability, the material thereof may selected appropriately according to the composites of the charged particle groups 25. Since it is necessary for the display substrate 16, which is one of the substrates, to transmit light, transparent materials among the above materials are preferably used.

Particle Charge Amount

Figure 2:
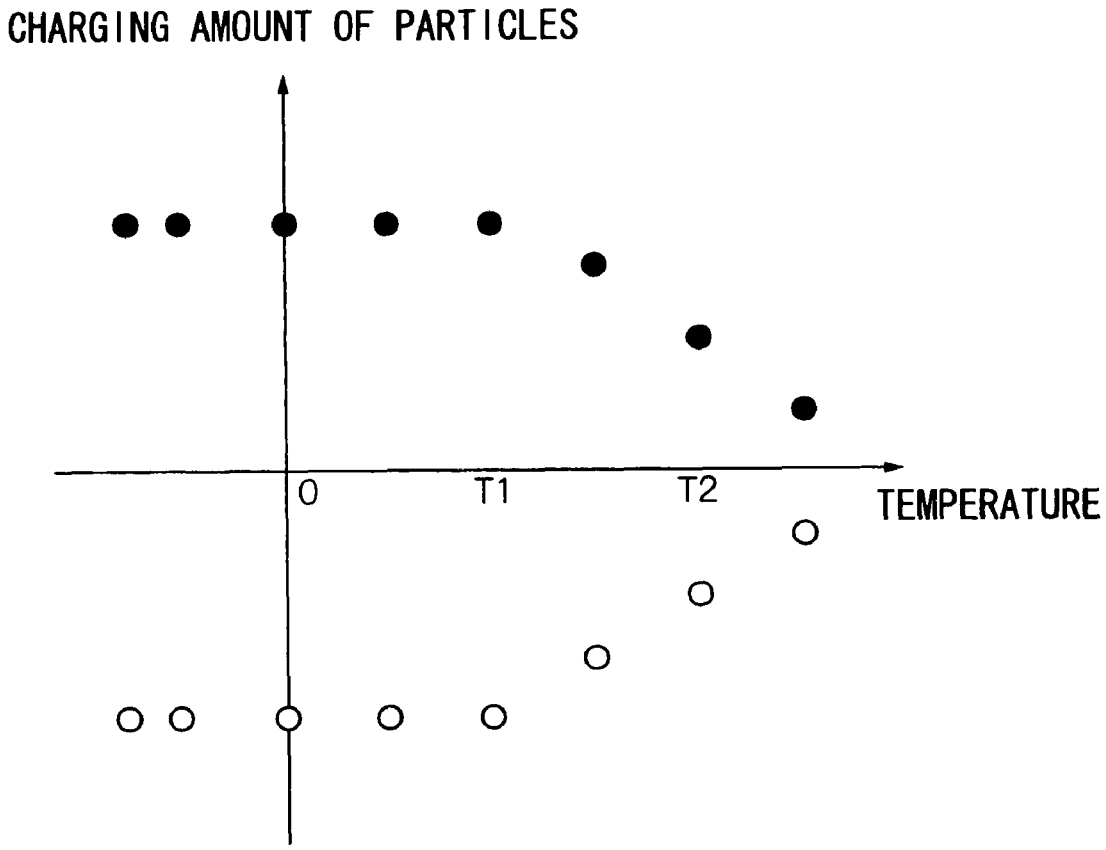
FIG. 2 is a diagram illustrating a relationship between environmental temperature and a charge amount of charged particles.

It has been confirmed that the charge amount of the charged particle groups 25 sealed into the image display medium 12 changes according to the environmental temperature. Specifically, as shown in FIG. 2, as the environmental temperature of the charged particle groups 25 gradually increases, the charge amount (μC/g) of the charged particle groups 25 is approximately constant at temperatures lower than a certain temperature T1 but when the temperature exceeds T1 the charge amount of the charged particle groups 25 starts to decrease. Further, when the environmental temperature rises, it is confirmed that the charge is ultimately lost.

The following hypothesis can be considered regarding the contributory factors to the reduction in the charge amount of the charged particle groups 25 caused by the temperature change of the image display medium 12.

Under a high temperature environment equal to or higher than a predetermined temperature, bleed, alternation and the like of monomer components of the resins, charge control agents, color materials, pigments and the other ingredients included in the charged particle groups 25 sealed into the image display medium 12 occurs. It is thought that the charge amount of the charged particle groups 25 changes as a result.

Further, outgas occurs from various induction substances included in the adhesives which are used for laminating the respective component materials of the spacing member 20, the display substrate 16 and the rear substrate 18, and in the display substrate 16, the rear substrate 18, the insulating layer 38, the insulating layer 30 and the like, which structure the image display medium 12. As the temperature becomes higher, the concentration of the outgas rises, and it is thought that the charge amount of the charged particle groups 25 decreases due to the influence of high concentration outgas.

Furthermore, since resin is mostly used as a base material of the charged particle groups 25 used in the image display medium 12, as the temperature becomes higher, the charged particle groups 25 tend to be softened. For this reason, when the image display medium 12 is placed under a high temperature environment, an electric field is formed between the display substrate 16 and the rear substrate 18, and the charged particle groups 25 transfer therebetween, the surface shape or the surface state of the charged particle groups 25 changes due to collision between the charged particle groups 25 or collision between the charged particle groups 25 and the display substrate 16 or the rear substrate 18. Thus, the charge amount of the charged particle groups 25 may be changed.

Using the charged particles employing the above-described various materials, the relationship of the charge amount of the charged particle groups 25 which are sealed into the image display medium 12 and the charge amount of the particles in cases where the environmental temperature rises was measured. The results of the measurement confirm that charged particle groups 25 which can maintain a substantially constant charge amount have not yet been found. Further, materials which can remarkably reduce emissions of outgas have not been realized under existing conditions.

Figure 3:
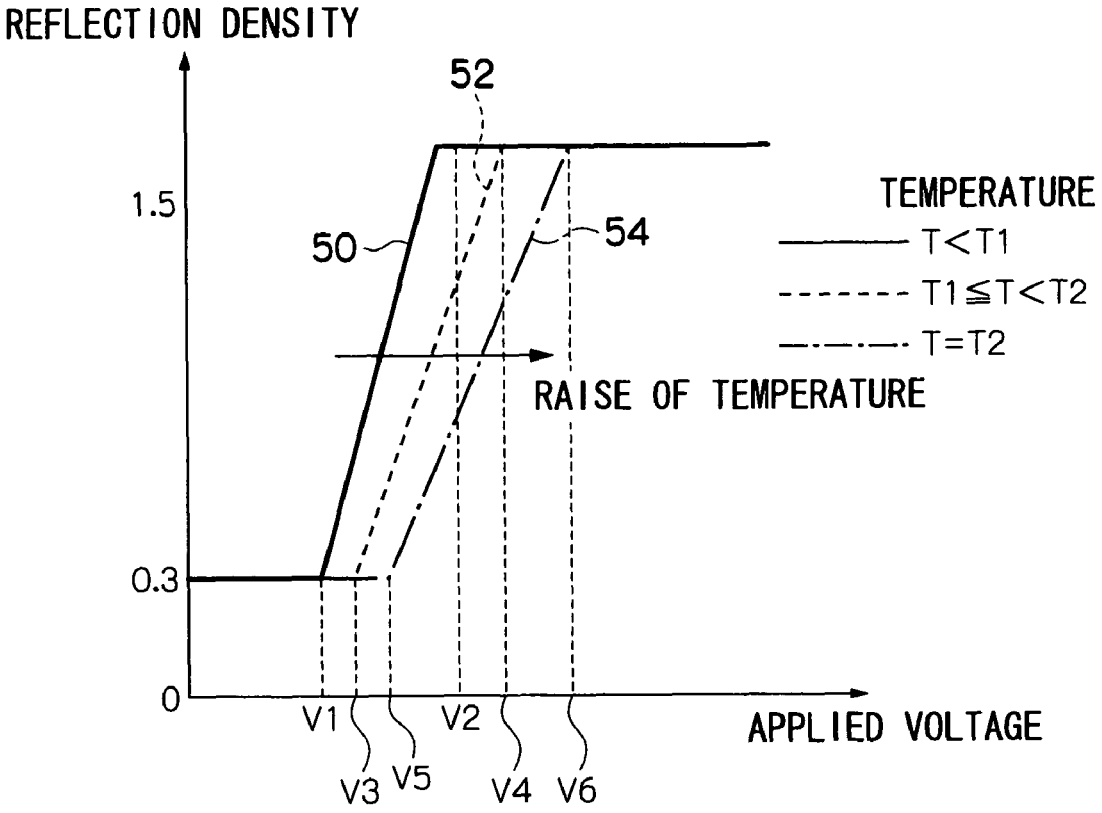
FIG. 3 is a diagram illustrating a relationship between an applied voltage and reflection density when a temperature of an image display medium is lower than T1, the temperature of the image display medium is equal to or higher than T1 and lower than T2, and the temperature of the image display medium is equal to T2.

FIG. 3 illustrates a relationship between the driving voltage applied to the linear electrodes 28 and 34 of the image display medium 12 and the reflection density (which corresponds to the display density of the present invention).

In FIG. 3, the image display medium 12 which has the configuration of FIG. 1 and is manufactured by the above manufacturing method is used as an object of the measurement. The black charged particles 24 (Techpolymer MBX-Black manufactured by SEKISUI PLASTICS CO., LTD.) and the white charged particles 22 (Techpolymer MBX-White manufactured by SEKISUI PLASTICS CO., LTD.) are sealed into the image display medium 12 as the charged particle groups 25. FIG. 3 illustrates the relationship between the driving voltage and the reflection density of the image display medium 12 under three different environmental temperatures.

Specifically, line 50 shows the transition of the reflection density in the case where after the image display medium 12 is left for 24 hours under the environment of temperature less (lower) than T1 so that its temperature becomes lower than T1, the driving voltage applied to the image display medium 12 is gradually raised under the environment of the temperature lower than T1. Line 52 shows the transition of the reflection density in the case where after the image display medium 12 is left for 24 hours at an environmental temperature which is equal to or higher than T1 and lower than T2 so that its temperature becomes the environmental temperature, the driving voltage applied to the image display medium 12 is gradually raised under the environment of this temperature (the temperature equal to or higher than T1 and lower than T2). Line 54 shows the transition of the reflection density in the case where after the image display medium 12 is left for 24 hours under the environment of temperature T2 so that its temperature becomes T2, the driving voltage applied to the image display medium 12 is gradually raised under the environment of temperature T2.

The temperature T1 is a threshold temperature at which, when the temperature of the image display medium 12 exceeds this value, the charge amount starts to decrease from the substantially constant state where the charge amount of the charged particle groups 25 is within a predetermined range. The temperature T2 is a temperature which is higher than T1 by a predetermined temperature, and when the temperature exceeds T2, the charged particle groups 25 are charged in a non-driven state (do not transfer due to the electric field), but when the charged particle groups 25 are driven by formation of the electric field, the charge amount becomes smaller than the predetermined range by a predetermined amount.

The reflection density is measured by a densitometer (X-Rite404A manufactured by X-Rite).

As shown in FIG. 3, when the temperature of the image display medium 12 is less than T1, the reflection density of the image display medium 12 starts to change when a value of applied voltage is V1, as shown by the line 50. After the reflection density has gradually increased as the applied voltage rises, the reflection density is saturated at a high-density state at a voltage value of V2 or more.

When the temperature of the image display medium 12 is equal to or higher than T1 and lower than T2, as shown by the line 52, the reflection density does not change at the voltage value (V1) corresponding to the starting of the change in the reflection density at the time when the temperature of the image display medium 12 is less than T1. When a voltage of V3 which is higher than V1 is applied, the reflection density changes. After the reflection density rises according to the rise in the applied voltage, when the voltage becomes equal to or higher than V4 which is higher than V2, the reflection density is saturated at a high-density state.

When the temperature of the image display medium 12 is T2 as shown by the line 54, when the voltage applied to the image display medium 12 is voltage value V1 and V3, the reflection density does not change. When a voltage V5 which is higher than V3 is applied, the reflection density changes. After the reflection density rises according to the rise in the applied voltage, when the voltage becomes equal to or higher than V6 which is higher than V4, the reflection density is saturated at a high-density state.

As shown in FIGS. 2 and 3, when the temperature of the charged particles 25 is equal to or higher than T1, Coulomb force which is received from the same voltage applied decreases due to the decrease of charge amount of the charged particle groups 25. For this reason, in an environment where the temperature is equal to or higher than T1, even when a driving voltage having the same value as that at the temperature where the charge amount is substantially constant (less than temperature T1) is applied between the substrates, it is difficult to obtain the same reflection density (i.e., the display density) of the charged particle groups 25 in an environment of a temperature less than T1.

As shown in FIG. 3, when the temperature of the image display medium 12 is equal to or higher than T1, the charge amount of the charged particle group 25 starts to decrease. However, when the charge amount decreases, if the driving voltage which is higher than the driving voltage before the decrease in the charge amount is applied to the image display medium 12, the contrast which is similar to the reflection density before the decrease in the charge amount can be obtained.

Evaluation of Display Characteristics

FIG. 4 illustrates a relationship between the temperature and the display characteristics of the image display medium 12.

In FIG. 4, the temperatures of image display media A and B into which charged particles with different composites (charged particles A and B) are sealed, respectively, are raised from −20° C. to 150° C. gradually. Namely, the image display media A and B are left for 24 hours at respective temperatures of −20° C., 0° C., 20° C., 40° C., 60° C., 70° C., 80° C., 100° C., 120° C. and 150° C. The driving voltage is respectively applied thereto so that black color is displayed on the entire surfaces of the image display media. Then, a display driving process, in which a series of the process for applying the driving voltage so that white color is displayed on the entire surfaces of the image display media is performed as one cycle, is executed for ten-thousands cycles, and the density of the image display media is measured by an image densitometer (X-Rite404A manufactured by X-Rite) every time when one cycle is ended.

When white color displaying is performed, image information for displaying white color on the entire surfaces of the image display media is used, and when black color displaying is performed, image information for displaying black color on the entire surfaces of the image display media is used. The driving voltage is applied to the image display medium 12 from the voltage applying unit 14 according to the respective image information.

Adjustment of Charged Particles A

The spherical black charged particles 24 (Techpolymer MBX-Black manufactured by SEKISUI PLASTICS CO., LTD.) and the spherical white charged particles 22 (Techpolymer MBX-White manufactured by SEKISUI PLASTICS CO., LTD.) are used, and they are mixed at a weight ratio of 3 to 5. The black charged particles 24 are made of carbon-containing crosslinking polymethyl methacrylate having a primary volume average grain size of 10 μm, mixed with Aerosil A130 impalpable (fine) powder which is subject to aminopropyltrimethoxysilane treatment, at a weight ratio 100 to 0.2. The spherical white charged particles 22 are made of titanium oxide-containing crosslinking polymethyl methacrylate having a primary volume average grain size of 10 μm, mixed with a Titania impalpable powder which is subject to isopropyltrimethoxysilane treatment, at a weight ratio of 100 to 0.1. (The same as the manufacturing method of the charged particles 25.)

The temperature T1 of the charged particles A is 70° C., and the temperature T2 is 100° C.

Adjustment of Charged Particles B

As the charged particles B containing a charging control agent, the spherical black charged particles 24 and the spherical white charged particles 22 are used. The black charged particles 24 contain diethyl amino ethyl methacrylate at a weight ratio of 100 to 1, having a volume average grain size of 10 μm and are made of carbon-containing crosslinking polymethylmethacrylate. The white charged particles 22 are made of titanium oxide-containing crosslinking polymethylmethacrylate having a volume average grain size of 10 μm. These particles are mixed at a weight ratio of 3 to 5. The temperature T1 of the charged particles B is 60° C., and the temperature T2 is 80° C.

Preparation of Image Display Medium A into which Charged Particles A are Sealed

The image display medium A is prepared similarly to the above-described manufacturing method of the image display medium.

Production of Image Display Medium B into which Charged Particles B are Sealed

The image display medium B is produced similarly to the above-described manufacturing method of the image display medium except that the charged particles A are changed into the charged particles B.

Display Characteristics Evaluation Criteria

◎: The case where among all of density measured results, the reflection density is equal to or less than 0.4 at the time of white display, and the reflection density is equal to or more than 1.5 at the time of black display (hereinafter, referred to as "satisfactory display characteristics").

○: The case where satisfactory display characteristics are not obtained before changing the driving voltage (i.e., the reflection density is larger than 0.4 at the time of white display, and the reflection density is less than 1.5 at the time of black display), and satisfactory display characteristics are obtained by changing a voltage applying condition of the driving voltage according to the temperature of the image display medium.

Δ: the case where satisfactory display characteristics are not obtained before application of the driving voltage, and when the driving voltage is applied, the charge amount further decreases.

X: The case where even when the driving voltage is applied, the density does not change (in the case where the charged particles are not driven).

As shown in FIG. 4, in both of the image display medium A into which the charged particles A are sealed and the image display medium B into which the charged particles B are sealed, it can be seen that satisfactory display characteristics can be obtained at a temperature of less than T1, and satisfactory characteristics can be obtained by adjusting the driving voltage at a temperature equal to or higher than T1 and less than T2. Further it can be seen that, when the driving voltage is applied at a temperature equal to or higher than T2, display characteristics are deteriorated or cannot be obtained (i.e., the charged particle groups 25 do not move between the substrates).

According to FIGS. 2, 3 and 4, by applying, to the image display medium 12, a driving voltage which enables achievement of a predetermined display density when the temperature of the display image medium 12 is less than T1, and applying, to the image display medium 12, a driving voltage which is higher than that before the reduction in the charge amount, or applying the driving voltage for a longer time than before the reduction in the charge amount, when the temperature of the image display medium 12 is equal to or higher than T1 and less than T2 display density which is similar to that before the reduction in the charge amount can be obtained. When the temperature of the image display medium 12 becomes equal to or higher than T2 it is difficult to obtain the display density which is similar to that before the reduction in the charge amount even if the driving voltage is adjusted.

The voltage applying unit 14 of the image display device 10 according to the invention predetermines a voltage applying condition of the driving voltage according to the temperature of the image display medium 12, and applies the driving voltage to the image display medium 12 based on the voltage applying condition corresponding to the temperature of the image display medium 12 measured by the temperature measuring unit 40.

In the control unit 14A of the voltage applying unit 14 in the image display device 10, in order to apply the driving voltage, to the image display medium 12, based on the voltage applying condition corresponding to the temperature, the processing routine shown in FIG. 5 is executed per predetermined time.

In the storage unit 14B, temperatures of the image display medium 12 and the voltage applying condition of the driving voltage, which is to be applied to the image display medium 12, are stored in advance in relation to each other.

The driving voltage to be applied to the image display medium 12 includes a display driving voltage to be applied to the image display medium 12 when an image according to the image information is displayed on the image display medium 12, and an initial driving voltage to be applied to the image display medium 12 before the display driving voltage is applied.

The initial driving voltage includes the voltage for displaying white color on the entire surface of the image display medium 12, a voltage for uniformly dispersing the charged particle groups 25 in the image display medium 12, a voltage for frictionally charging the charged particle groups 25, and the like. In the invention, the initial driving voltage is described as a voltage which is to be applied to the image display medium 12 in order to frictionally charge the charged particle groups 25.

The voltage applying condition corresponding to the temperature of the image display medium 12 may be a condition such that the charged particle groups 25 sealed into the image display medium 12 can transfer between the substrates so that predetermined display density can be attained. At least one or more of display driving voltage, voltage applying time of the display driving voltage, the number of the repetitive applications of the display driving voltage, initial driving voltage and voltage applying time of the initial driving voltage may be determined as the voltage applying condition.

In this embodiment, each of the display driving voltage, the voltage applying time of the display driving voltage, the number of repetitive applications of the display driving voltage, the initial driving voltage, and the voltage applying time of the initial driving voltage, which respectively correspond to the voltage applying conditions at the time when the temperature of the image display medium 12 is less than T1, are stored in advance as the initial setting values in the storage unit 14B. The display driving voltage, the voltage applying time of the display driving voltage, the number of repetitive applications of the display driving voltage, the initial driving voltage, and the voltage applying time of the initial driving voltage, which correspond to voltage applying conditions when the temperature is equal to or higher than T1, are also predetermined. These values are determined to be larger than the initial setting values according to a reduction ratio of the charge amount of the charged particle groups 25 as the temperature becomes equal to or higher than T1, in order to obtain the same display density which is obtained when the driving voltage of the initial setting values of the voltage applying conditions is applied to the image display medium 12.

In this embodiment, the initial setting values are values such that, as the predetermined display density, reflection density equal to or less than 0.4 can be obtained when the driving voltage is applied to display white color on the image display medium 12, and reflection density equal to or higher than 1.5 can be obtained when the driving voltage is applied in order to display black color on the image display medium 12. However, the initial setting values are not limited to such values.

The temperatures T1 and T2 of the charged particle groups 25 sealed into the image display medium 12 are stored in advance in the storage unit 14B.

In the control unit 14A of the voltage applying unit 14, the processing routine shown in FIG. 5 is executed per predetermined time and proceeds to step 100. In step 100, whether or not an image according to image information input from the image information input unit 42 is to be displayed on the image display medium 12 is determined. The determination at step 100 may be made regardless of whether or not an image display instruction signal input by a user's pressing operation on an instruction button (not shown) provided at the image display device 10 for instructing image displaying, for example, is input. The determination can be also made by determining, when the image information is input from the image information input unit 42, whether or not the image displaying is instructed.

When the determination is negative at step 100, the routine ends. When the determination is affirmative, the routine proceeds to step 101 and temperature T of the image display medium 12 measured by the temperature measuring unit 40 is read.

At the next step 102, a determination is made whether the temperature T of the image display medium 12 read at step 101 is less than T1 or equal to or higher than T1.

At step 102, when the temperature T of the image display medium 12 read at step 101 is less than T1 the routine proceeds to step 103.

At step 103, the respective initial setting values of the initial driving voltage and the display driving voltage stored in the storage unit 14B are copied to a voltage setting value memory area for execution in the storage unit 14B.

At next step 104, the voltage value (level) and the applying time of the initial driving voltage are read from the voltage setting value memory area for execution in the storage unit 14B. At next step 106, the initial driving voltage according to the voltage value and the applying time read at step 104 is applied to the image display medium 12.

At next step 108, the value (level) of the display driving voltage, the applying time of the display driving voltage and the number of the repetitive applications of the display driving voltage are read from the voltage set value memory area for execution in the storage unit 14B. At next step 110, the display driving voltage according to the voltage value, the applying time and the number of the repetitive applications read at step 108 is applied to the image display medium 12.

At the process of step 106, the initial driving voltage is applied to the image display medium 12 and the charged particle groups 25 sealed into the image display medium 12 are frictionally charged by an electric field generated by the applied initial driving voltage, and then the process at step 110 is executed. As a result, when the display driving voltage according to the image to be displayed on the image display medium 12 is applied to the image display medium 12, the charged particle groups 25 transfer between the display substrate 16 and the rear substrate 18 of the image display medium 12 due to the electric field generated by the applied display driving voltage, so that the image according to the input image information is displayed on the image display medium 12.

At next step 112, the information stored in the voltage value memory area for execution in the storage unit 14B is cleared, and then the routine ends.

On the other hand, at step 102, when the temperature T of the image display medium 12 read at step 101 is equal to or higher than T1, the routine proceeds to step 114. At step 114, determination is made whether the temperature T of the image display medium 12 read at step 102 is less than T2 or not.

When the determination is negative at step 114 and the temperature T of the image display medium 12 read at step 102 is equal to or higher than T2, the routine ends.

That is, in the image display device 10 of the present invention, when the temperature of the image display medium 12 is equal to or higher than T2 at which the charging characteristic of the charged particle groups 25 sealed into the image display medium 12 is further deteriorated by driving, image display can be controlled so as not to be performed.

On the other hand, when the determination is affirmative at step 114 and the temperature T of the image display medium 12 is equal to or higher than T1 and less than T2, the routine proceeds to step 116.

At step 116, one or both of value (level) and the applying time of the initial driving voltage stored in the storage unit 14B is (are) changed to be larger than the initial setting values by a predetermined value according to the temperature T of the image display medium 12 read at step 101.

Specifically, at the process of step 116, the initial driving voltage is changed based on the relation between the temperature and the initial setting value stored in the storage unit 14B so as to be the initial driving voltage with value and applying time corresponding to the temperature T of the image display medium 12 which is read at step 101.

At next step 118, the value (level) of the display driving voltage, the applying time of the display driving voltage, and the number of repetitive applications of the display driving voltage are changed so as to be larger than the initial setting values by predetermined values according to the temperature T of the image display medium 12 read at step 102.

Specifically, at the process of step 118, the display driving voltage is changed based on the relation between the temperature and the initial setting value stored in the storage unit 14B so that the value, the applying time and the number of repetitive applications correspond to the temperature T of the image display medium 12 read at step 101.

Alternately, the initial driving voltage can be set to be the same as in the case when the temperature is less than T1 at step 116, and only the display driving voltage may be changed at step 118. Further, if the charge amount of the charged particles is recovered (becomes equivalent to the charge amount of the particles at a temperature less than T1) by the initial driving process using the initial driving voltage set at step 116, the display driving voltage does not have to be changed, at step 118, from that at a temperature less than T1 In this case, the initial driving conditions according to the temperature are stored in advance in a table, and the initial driving conditions according to the temperature T are selected from the table and the process is executed.

However, in both the above cases, high driving voltage may be required and/or the total time for display may become long. Therefore, as shown in FIG. 5, it is preferable to use both the initial driving voltage set at step 116 and the display driving voltage set at step 118.

At next step 120, the setting values changed at steps 116 and 118, such that the changed values of the initial driving voltage, the changed applying time of the initial driving voltage, the changed value of the display driving voltage, the changed applying time of the display driving voltage, and the changed number of repetitive applications of the display driving voltage after change are stored in the voltage setting value memory area for execution of the storage unit 14B. Thereafter, the routine proceeds to step 104.

At step 104, the initial driving voltage whose initial setting values are changed according to the temperature T of the image display medium 12 is read from the voltage setting value memory area for execution of the storage unit 14B. At next step 106, the initial driving voltage with the read value and the voltage applying time is applied to the image display medium 12.

At next step 108, the display driving voltage whose initial setting values are changed according to the temperature T of the image display medium 12 is read from the voltage setting value memory area for execution of the storage unit 14B. At next step 110, the image display voltage with the read value, the applying time and the number of the repetitive applications is applied to the image display medium 12. Thereafter, the voltage setting value memory area for execution is cleared at step 112, and then the routine ends.

As described above, the present invention can be realized as an image display device that includes a voltage applying unit which applies a driving voltage, between the substrates, according to the temperature of the image display medium measured by the temperature measuring unit, based on the voltage applying conditions which are predetermined according to the temperature of the image display medium, in order to display an image with predetermined display density at the image display medium.

In the image display device, the voltage applying condition may be at least one of (a) a voltage value of a display driving voltage to be applied between the substrates in order to display an image on the image display medium; (b) a voltage applying time of the display driving voltage; and (c) a number of voltage applications of the display driving voltage.

By this configuration, the voltage applying conditions are easily adjusted, and the reduction in the display density at the time when an image is displayed on the image display medium can be suppressed.

In the image display device, the voltage applying condition may be at least one of: (a) a voltage value of an initial driving voltage to be applied between the substrates before a display driving voltage is applied between the substrates in order to display an image on the image display medium; and (b) a voltage applying time of the initial driving voltage.

The voltage applying unit can apply, between a pair of substrates, an initial driving voltage having a voltage value and/or voltage applying time based on voltage applying conditions corresponding to the temperature of the image display medium. Therefore, when an initial driving voltage is applied such that the charge amount can be recovered by the charging friction of the charged particle groups, the charged particle groups whose charge amount is reduced can be frictionally charged sufficiently by the application of the initial driving voltage.

In the voltage applying unit, the voltage applying conditions according to the temperature of the image display medium can be at least one of the voltage value (level) of the initial driving voltage corresponding to the temperature, the voltage applying time of the initial driving voltage corresponding to the temperature, the voltage value (level) of the display driving voltage corresponding to the temperature, and the voltage applying time of the display driving voltage corresponding to the temperature.

The image display device may be configured such that, when the environmental temperature is less than a first temperature, a charge amount of the charged particle groups is within a first range, and when the environmental temperature is equal to or higher than the first temperature, the charge amount changes so as to deviate from the first range.

For this reason, when the driving voltage is applied between the substrates based on the voltage applying condition corresponding to the temperature of the image display medium into which the charged particle groups are sealed, even if the charge amount of the charged particle groups are changed so as to deviate from the first range due to the environmental temperature becoming equal to or higher than the first temperature, a reduction in the display density can be suppressed.

The image display device may be configured such that, with respect to a temperature of the image display medium which is equal to or higher than the first temperature, at least one of: (a) a voltage value higher than that of a display driving voltage to be applied when the temperature is less than the first temperature; (b) voltage applying time longer than that of the display driving voltage to be applied when the temperature is less than the first temperature; and (c) a number of voltage applications larger than the number of repetitive applications of the display driving voltage to be applied when the temperature is less than the first temperature, is predetermined as the voltage applying condition.

Thus, when the temperature of the image display medium is equal to or higher than the first temperature, a display driving voltage that enables the charged particle groups to transfer between the substrates in order to obtain approximately the same display density as in the case when the temperature of the image display medium is less than the first temperature, can be applied between the substrates. For this reason, even when the charge amount of the charged particle groups changes, a reduction in the display density can be suppressed.

The image display device may be configured such that, with respect to a temperature of the image display medium which is equal to or higher than the first temperature, at least one of: (a) a voltage value higher than that of an initial driving voltage to be applied when the temperature is less than the first temperature; and (b) voltage applying time longer than that of the initial driving voltage to be applied when the temperature is less than the first temperature, is predetermined as the voltage applying condition.

Thus, even in the case where the temperature of the image display medium is equal to or higher than the first temperature, when an initial driving voltage is applied which enables the charge amount to be recovered by the charging friction of the charged particle groups, the charge amount of the charged particle groups can be recovered. For this reason, even when the charge amount of the charged particle groups is changed, the reduction in the display density can be suppressed.

Further, when the temperature of the image display medium is equal to or higher than the first temperature, a display driving voltage which enables the charged particle groups to transfer between the substrates in order to obtain approximately the same display density as in the case when the temperature of the image display medium is less than the first temperature, can be applied and, also, an initial driving voltage which enables the charge amount of the charged particle groups to be recovered in order to obtain approximately the same display density as in the case when the temperature of the image display medium is less than the first temperature, can be applied. Therefore, even if the charge amount of the charged particle groups changes, a reduction in the display density can be suppressed.

The image display device may be configured such that, when the charged particle groups are driven in an environmental temperature equal to or higher than a second temperature, which is higher than the first temperature by a predetermined temperature, the charge amount is within a second range which is less than the first range by a predetermined amount, and when the temperature of the image display medium measured by the temperature measuring unit is equal to or higher than the second temperature, the voltage applying unit prohibits application of the driving voltage to the image display medium.

The image display device may be configured such that the temperature measuring unit measures the temperature of at least one of the pair of substrates.

For this reason, the environmental temperature of the charged particles can be measured with high accuracy.

The present invention can be also realized as a method corresponding to the operation of the above described image display device.

According to the image display device and the method of the invention, the value and the voltage applying time of the initial driving voltage can be controlled according to the temperature of the image display medium 12, and the value, the voltage applying time and the number of repetitive applications of the display driving voltage can be controlled according to the temperature of the image display medium 12. For this reason, even when the charge amount of the charged particle groups 25 is reduced due to the rise in the temperature, the reduction of the display density can be suppressed.

Specifically, when the temperature of the image display medium 12 is less than the temperature T1 which is a threshold temperature at which the charge amount of the charged particles starts to be reduced from the constant state due to the rise in the temperature, the value and the voltage applying time (initial setting values) of the initial driving voltage for driving the charged particle groups 25 in order to attain predetermined display density, and the value, the voltage applying time and the number of repetitive applications of the display driving voltage for driving the charged particle groups 25 in order to attain predetermined display density, are controlled.

When the temperature of the image display medium 12 is equal to or higher than T1 and less than T2, which is a threshold temperature at which the particle groups are charged in a non-driving state but the charge amount will be further reduced by driving, the initial driving voltage is controlled so that the value and the voltage applying time become larger than the initial setting value by a value according to a reduction ratio of the charge amount of the charged particle groups 25. Further, the display driving voltage is controlled so that the value, the voltage applying time, and the number of repetitive applications become larger, by a value according to the reduction ratio of the charge amount, than that in the case where the temperature of the image display medium 12 is less than the temperature T1.

Thus, when the temperature of the image display medium 12 is equal to or higher than temperature T1, the value and/or the voltage applying time of the initial driving voltage is controlled to be higher (longer) than the case where the temperature is less than temperature T1. Thereby, the charged particles whose charge amount is reduced due to the rise in temperature can be frictionally charged sufficiently. Therefore, reduction in the display density due to a change in the charged particles can be suppressed.

Further, when the temperature of the image display medium 12 is equal to or higher than temperature T1 the value, the voltage applying time and the number of the repetitive applications of the display driving voltage are controlled to be higher (longer) than the case where the temperature is less than the temperature T1. Thereby, even if the charge amount of the charged particles is reduced due to the rise in temperature, they can be driven between the display substrate 16 and the rear substrate 18 so that predetermined display density can be attained. The reduction in the display density due to the change in charged particles can be suppressed.

In the case where the temperature of the image display medium 12 is equal to or higher than T2, the charge amount of the charged particle groups 25 further decreases and cannot be recovered when the charged particle groups 25 are driven. As a result, the initial driving voltage and the display driving voltage can be controlled so as not to be applied to the image display medium 12, in order to prevent image displaying. Thereby, a deterioration in the image display device 12 under high temperature (T2 or more) at which the charge amount of the charged particle groups 25 is further reduced can be suppressed. Therefore, reduction in the display density due to the change in the charged particles can be suppressed.

In the present embodiment, a case where the initial setting values including the value and the applying time of the initial driving voltage, and the value, the applying time and the number of the repetitive applications of the display driving voltage are stored in advance in the storage unit 14B, and these values, the applying time and the number of the repetitive applications are changed according to the temperature of the image display medium 12, is described. However, any one or more of the value and the applying time of the initial driving voltage, and the value, the applying time and the number of the repetitive applications of the display driving voltage may be selectively changed.

Further, a case where the value, the applying time and the number of repetitive applications of the initial driving voltage and the display driving voltage are changed is described herein. However, voltage value, pulse width and pulse number of the initial driving voltage and the display driving voltage may be changed. Specifically, when the temperature of the image display medium 12 is equal to or higher than T1, any one or more of the voltage value, the pulse width and the pulse number may be controlled to be higher (longer or larger) than the case of the temperature less than T1, according to the reduction in charge amount.

As described above, according to the image display device and the method of the present invention, the driving voltage based on the voltage applying condition for displaying an image with predetermined display density on the image display medium is applied between the substrates according to the temperature of the image display medium measured by the temperature measuring unit. For this reason, even when the charged particle groups are at an environmental temperature where predetermined display density cannot be attained by the charge amount of the charged particle groups due to a change in temperature, the driving voltage based on the voltage applying condition can be applied between the substrates according to the temperature of the image display medium into which the charged particle groups are sealed. Therefore, even when the charge amount of the charged particle groups changes according to a change in environmental temperature, reduction in display density can be suppressed.

What is claimed is:

1. An image display device, comprising:

an image display medium wherein charged particle groups are sealed between a pair of substrates at least one of which has translucency and which are opposed to each other with a space therebetween, and display density is changed by transfer of the charged particle groups between the pair of substrates according to an electric field formed by a voltage applied between the substrates;

a temperature measuring unit that measures a temperature of the image display medium; and a voltage applying unit that applies, between the substrates, a driving voltage according to the temperature of the image display medium that is measured by the temperature measuring unit, based on a predetermined voltage applying condition corresponding to the temperature of the image display medium in order to display an image in predetermined display density on the image display medium, wherein a voltage applying unit applies the driving voltage according to temperature ranges including:

a first temperature range in which the temperature of the image display medium is less than a first temperature, wherein the charge amount of the charged particle groups is within a first range, a second temperature range in which the temperature of the image display medium is equal to or greater than the first temperature, but less than a second temperature, the second temperature being higher than the first temperature by a predetermined temperature, wherein the charge amount is less than the charge amount at any temperature of the first range, and a third temperature range in which the temperature of the image display medium is equal to or greater than the second temperature, which is the temperature at which the charged particle groups do not transfer between the pair of substrates even if the driving voltage is applied, wherein the charge amount is within a second range which is less than the first range by a predetermined amount, and the voltage applying unit prohibits application of the driving voltage to the image display medium.

2. The image display device according to claim 1, wherein the voltage applying condition is at least one of: (a) a voltage value of a display driving voltage to be applied between the substrates in order to display an image on the image display medium; (b) a voltage applying time of the display driving voltage; and (c) a number of voltage applications of the display driving voltage.

3. The image display device according to claim 1, wherein the voltage applying condition is at least one of: (a) a voltage value of an initial driving voltage to be applied between the substrates before a display driving voltage is applied between the substrates in order to display an image on the image display medium; and (b) a voltage applying time of the initial driving voltage.

4. The image display device according to claim 1, wherein, with respect to a temperature of the image display medium which is equal to or higher than the first temperature, at least one of: (a) a voltage value higher than that of a display driving voltage to be applied when the temperature is less than the first temperature; (b) voltage applying time longer than that of the display driving voltage to be applied when the temperature is less than the first temperature; and (c) a number of voltage applications larger than the number of repetitive applications of the display driving voltage to be applied when the temperature is less than the first temperature, is predetermined as the voltage applying condition.

5. The image display device according to claim 1, wherein, with respect to a temperature of the image display medium which is equal to or higher than the first temperature, at least one of: (a) a voltage value higher than that of an initial driving voltage to be applied when the temperature is less than the first temperature; and (b) voltage applying time longer than that of the initial driving voltage to be applied when the temperature is less than the first temperature, is predetermined as the voltage applying condition.

6. The image display device according to claim 1, wherein, with respect to a temperature of the image display medium which is equal to or higher than the first temperature, at least one of: (a) a voltage value higher than that of a display driving voltage to be applied when the temperature is less than the first temperature; (b) voltage applying time longer than that of the display driving voltage to be applied when the temperature is less than the first temperature; (c) a number of voltage applications larger than the number of repetitive applications of the display driving voltage to be applied when the temperature is less than the first temperature; (d) a voltage value higher than that of an initial driving voltage to be applied when the temperature is less than the first temperature; and (e) voltage applying time longer than that of the initial driving voltage to be applied when the temperature is less than the first temperature, is predetermined as the voltage applying condition.

7. The image display device according to claim 1, wherein the temperature measuring unit measures the temperature of at least one of the pair of substrates.

8. The image display device according to claim 1, wherein the voltage applying unit comprises a storage unit that stores the voltage applying condition in advance, and a control unit that applies the driving voltage based on the voltage applying condition stored in the storage unit and the temperature of the image display device measured by the temperature measuring unit.

9. An image display method of displaying an image on an image display device having an image display medium, the image display medium being configured such that charged particle groups are sealed between a pair of substrates at least one of which has translucency and which are opposed to each other with a space therebetween, and display density is changed by transfer of the charged particle groups between the pair of substrates according to an electric field formed by a voltage applied between the substrates, the method comprising:

measuring a temperature of the image display medium with a temperature measuring unit; and applying, between the substrates, a driving voltage according to the temperature of the image display medium which is measured by the temperature measuring unit, based on a predetermined voltage applying condition corresponding to the temperature of the image display medium, in order to display an image in predetermined display density on the image display medium, wherein the driving voltage is applied according to temperature ranges including:

a first temperature range in which the temperature of the image display medium is less than a first temperature, wherein the charge amount of the charged particle groups is within a first range, a second temperature range in which the temperature of the image display medium is equal to or higher than the first temperature, but less than a second temperature, the second temperature being higher than the first temperature by a predetermined temperature, wherein the charge amount is less than the charge amount at any temperature of the first range, and a third temperature range in which the temperature of the image display medium is equal to or greater than the second temperature, which is the temperature at which the charged particle groups do not transfer between the pair of substrates even if the driving voltage is applied, wherein the charge amount is within a second range which is less than the first range by a predetermined amount, and the voltage applying unit prohibits application of the driving voltage to the image display medium.

10. The image display method according to claim 9, further comprising storing the voltage applying condition in advance.

11. The image display method according to claim 9, wherein the voltage applying condition is at least one of: (a) a voltage value of a display driving voltage to be applied between the substrates in order to display an image on the image display medium; (b) a voltage applying time of the display driving voltage; and (c) a number of voltage applications of the display driving voltage; (d) a voltage value of an initial driving voltage to be applied between the substrates before the display driving voltage is applied between the substrates in order to display an image on the image display medium; and (e) a voltage applying time of the initial driving voltage.

12. The image display method according to claim 9, wherein when the temperature of the image display medium is equal to or higher than the first temperature, the voltage applying condition is predetermined to be at least one of:

a) a voltage value higher than that of a display driving voltage to be applied when the temperature is less than the first temperature;

b) voltage applying time longer than that of the display driving voltage to be applied when the temperature is less than the first temperature;

c) a number of voltage applications larger than the number of repetitive applications of the display driving voltage to be applied when the temperature is less than the first temperature;

d) a voltage value higher than that of an initial driving voltage to be applied when the temperature is less than the first temperature; and e) voltage applying time longer than that of the initial driving voltage to be applied when the temperature is less than the first temperature.

13. The image display method according to claim 9, wherein the measuring measures the temperature of at least any one of the pair of substrates.

* * * * *